US007382692B1

(12) United States Patent
Hildebrandt

(10) Patent No.: US 7,382,692 B1
(45) Date of Patent: Jun. 3, 2008

(54) ADD-ON TIMER FOR MEDICINE CONTAINER

(75) Inventor: William K. Hildebrandt, Inman, SC (US)

(73) Assignee: Add-On Timer, LLC, Spartanburg, SC (US)

( * ) Notice: Subject to any disclaimer, the term of this patent is extended or adjusted under 35 U.S.C. 154(b) by 0 days.

(21) Appl. No.: 11/600,549

(22) Filed: Nov. 16, 2006

(51) Int. Cl.
*G04B 47/00* (2006.01)

(52) U.S. Cl. ..... 368/10; 368/110; 368/278; 200/572

(58) Field of Classification Search ..... None
See application file for complete search history.

(56) References Cited

U.S. PATENT DOCUMENTS

| | | | | |
|---|---|---|---|---|
| 4,419,016 | A | 12/1983 | Zoltan | 368/10 |
| 4,849,948 | A | 7/1989 | Davis et al. | 368/10 |
| 4,939,705 | A | 7/1990 | Hamilton et al. | 368/10 |
| 5,016,230 | A * | 5/1991 | Seifers et al. | 368/10 |
| 5,233,571 | A * | 8/1993 | Wirtschafter | 368/10 |
| 5,625,334 | A | 4/1997 | Compton | 340/309.15 |
| 5,751,660 | A | 5/1998 | Chappell | 368/10 |
| 5,751,661 | A | 5/1998 | Walters | 368/10 |
| 5,852,590 | A | 12/1998 | de la Huerga | 368/10 |
| 6,324,123 | B1 | 11/2001 | Durso | 368/10 |
| 6,424,599 | B1 * | 7/2002 | Ditzig | 368/10 |
| 6,633,796 | B1 | 10/2003 | Pool et al. | 700/231 |
| 6,667,936 | B1 * | 12/2003 | Ditzig | 368/10 |
| 6,710,703 | B2 | 3/2004 | Huang | 340/309.16 |
| 6,845,064 | B2 | 1/2005 | Hildebrandt | 368/10 |
| 2005/0121407 | A1 | 6/2005 | Hildebrandt | 215/228 |

* cited by examiner

*Primary Examiner*—Renee S Luebke
(74) *Attorney, Agent, or Firm*—Monahan & Moses, LLC; Timothy J. Monahan

(57) ABSTRACT

An add-on timer for a medicine container is provided having a base plate affixed to the top of an existing lid, a housing overlaying and coupled to the base plate, and a timing unit within the housing. The housing is displaceable relative to the base plate by a person depressing or twisting the housing, which actuates a switch and resets the timing unit. A display indicates the elapsed time since the container was last accessed, to assist a patient in following dosage instructions.

20 Claims, 6 Drawing Sheets

ADD-ON TIMER FOR MEDICINE CONTAINER

BACKGROUND OF THE INVENTION

The present invention relates generally to a timer for containers or dispensers, which displays the time that has elapsed since the container was last opened, and in particular to a timer that can be affixed to the lid of a conventional container for prescription medicine.

Errors related to the administration of medication are well documented in pharmacy and medical literature. Many administration errors are due to inappropriate time intervals between doses. The result can be either overdosing leading to toxicity, or under-dosing causing a sub-therapeutic drug blood level. There are solutions to this dosage interval problem in prior art, but problems permeate these prior solutions. These problems may be divided into five general areas.

First, there are the timing devices that require repackaging the medication, that is, removing the medication from the container originally provided by the pharmacy or manufacturer. These devices may result in errors during repackaging, loss of original labeling, and loss of physical and chemical protection provided by the original dispenser.

Second, some timing devices replace the original lid, while retaining the original bottle or vial that was provided with the medicine dispenser. This again may alter the physical and chemical properties of the original packaging. Replacement of the original lid also necessitates that the timing device be manufactured in a vast array of configurations and sizes to fit the large variety of containers currently in the marketplace.

Third, medicines provided as a liquid present problems, as the closures for bottles are different than those found on containers of solid dosage forms, such as vials. For example, the closures for bottles are typically screw-on caps, which create an air-tight seal. Many of the prior art timing devices cannot be readily adapted to bottle caps.

Fourth, many timing devices and systems require programming or record keeping. Programming can be difficult for patients who are disabled or elderly. Multiple medications can complicate programming requirements and multiple caregivers can add to problems with devices that are difficult to use.

Fifth, various original container lids require a particular pressure and/or motion to open and close the container. Not all add-on devices are compatible with the range of lid types offered. Further, some prior art timers are equipped with manual reset features or procedures in an attempt to expand their utility. But, if the timer is not automatically actuated by the act of accessing the contents of the container, and the patient is required to manually reset the timer, then the reliability of the timer can be compromised.

Examples of timers for medication dispensers are shown in the following references. U.S. Pat. No. 4,419,016 discloses a timing device for indicating when the medication was last accessed, which includes a container with a screw on cap. The cap contains a compression switch to indicate the time when the container was last opened to remove a dosage of medication or to display the time elapsed since the cap was last taken off of the container. The cap is said to fit standard vials or container. Variations of a compression switch are disclosed, such as a pliable extension which is inserted between the cap threads and the bottle neck threads so that as the cap is threaded on the neck, the pliable extension is compressed and contacts within the extension are actuated.

U.S. Pat. No. 4,939,705 discloses a container and cap combination, wherein a timing device in the cap measures a time interval between when the cap is removed and when the cap in reinstalled to determine a true medical dose access event and distinguish them from false events. Additionally, the timing device may include a memory for storing events, and the memory can be accessed and reviewed. The disclosed dispensing container would require redistribution of medicine from the original containers presently used by pharmacies.

U.S. Pat. No. 5,233,571 discloses a replacement cap for medicine dispensers. The original lid is replaced by a cap containing a timer/alarm, which is activated by a compression switch. Since the cap is intended to substitute for the original lid, the cap is provided with internal threads or other means to engage the container. Consequently, the replacement cap must be matched to fit a particular, original container for medicine.

U.S. Pat. No. 5,751,660 discloses a timing device having a specially designed container (vial) and a base for supporting the vial. The base includes a push button that needs to be actuated by a patient, to set the time at which the medication was taken.

U.S. Pat. No. 6,845,064 describes an add-on medicine dispenser timer, which can be affixed to a conventional medicine dispenser lid. The add-on timer has a housing, with resilient side walls. The side walls flex when downward pressure is applied to the housing and a compression switch is actuated, which resets the timer. Visual inspection of the display indicates proper reset of the device.

The objectives of the present invention are therefore to provide a device for the timely administration of medication that does not require the repackaging of medications from the original container and that does not require replacement of the original container lid. The timing device should be compatible with and readily actuate when used on all types of child safety and other closures commonly found on both solid and liquid dosage forms of both prescription and over-the-counter medications. Additionally, the timing device should be simple to use and not require programming or initial set-up, other than the affixation to an existing container lid. Once the add-on timer is properly affixed to an existing container lid, accessing the contents of the container should actuate the device. The affixed timing device should not significantly alter the pressure or motion required to access the container. Further objectives are to provide a device that is compact, inexpensive to manufacture, and reliable.

SUMMARY OF THE INVENTION

The present invention is an add-on timer, which can be affixed to a wide variety of surfaces. It is particularly useful for containers designed for medicine, including bottles and vials used for liquids, tablets or capsules. The present invention is particularly useful when affixed to lids that require twisting the lid, or application of a downward force on the lid, or both, to remove the lid and access the contents of the container, or to replace the lid.

The add-on timer has a base plate, a housing coupled to the base plate, a switch and a timing unit, positioned between the housing and the base plate. The underside of the base plate has means to affix the base plate to the upper surface of an existing lid for a container.

The housing has a top and side walls, and the housing is positioned to overlay the upper side of the base plate. The housing and base plate are coupled together to allow relative movement between the two, while preventing the housing from becoming separated from the base plate. The relative movement allowed between the housing and the base plate may be (i) rotational, that is, the housing may pivot on a central axis perpendicular to the base plate and lid, while overlaying the base plate; (ii) compressive, that is, the housing may be displaceable between a first position, at a distance away from the base plate, and a second position, at a distance toward or closer to the base plate, wherein the displacement is along an axis substantially perpendicular to the base plate and lid; or (iii) both rotational and compressive.

The present invention is designed to reset the clock when the container to which the add-on timer has been affixed is accessed, by causing displacement of the housing relative to the base plate. It can be understood that it is possible to combine features of the aforementioned embodiments, so that the housing will be displaced and the timing unit switch actuated when either compressive force is applied, that is, applied perpendicular to the top of the housing, or rotational force is applied, that is, applied by twisting the housing, or both compressive and rotational force are applied.

In one embodiment of the invention, the housing is free to pivot relative to the base plate, about an imaginary, central axis perpendicular to the base plate, and the add-on timer is provided with means to draw the housing toward the base plate a sufficient distance to actuate the switch and reset the clock, when the housing is pivoted. For example, a means to draw the housing toward the base plate when the housing is pivoted is to provide one component (housing or base plate) with a plurality of tracks and the other component having a plurality of tabs, whereby the components are mated to allow the tabs to slide in the tracks. The tracks are angled relative to a plane defined by the base plate, so that the housing is displaced downward when the housing is pivoted, that is, twisted. In another embodiment of the invention, a means to draw the housing toward the base plate when the housing is pivoted is for the housing and base plate to be coupled together by a plurality of cords, with each cord having an end attached to the inside of the housing and an opposite end attached to the base plate.

In yet another embodiment of the invention, the housing may be free to rotate a full 360° relative to the base plate, when the housing is in a first position away from the base plate, and the housing must be depressed to the second position toward the base plate, in order to engage and twist the base plate and lid. Teeth may be provided on the housing and the base plate, at the point of engagement, to facilitate the transfer of rotational force applied to the housing. Depressing the housing actuates the timing unit switch.

The switch is positioned between the housing and the base plate. The switch is a device that is actuated, that is, exhibits a detectable change in electrical status, upon displacement of the housing relative to the base plate.

The timing unit is positioned between the housing and the base plate. The timing unit has a battery, a clock, a display for the clock, which is viewable from outside of the housing, and means to detect a switch actuation event and reset the clock. Resetting the clock encompasses zeroing the clock and restarting the clock to count the elapsed time.

In addition to the foregoing, the present invention may include one or more of the following features:

The housing and/or the base plate are rigid;

The top of the housing and the base plate are substantially parallel;

The upper side of the base plate has a projection on its upper side, which compresses the switch and resets the clock when the housing is displaced toward the base plate.

DETAILED DESCRIPTION OF THE INVENTION

Without limiting the scope of the invention, the preferred embodiments and features are hereinafter set forth. All of the United States patents, which are cited in the specification, are hereby incorporated by reference.

Suitable containers may be generally described as comprising a receptacle having an opening to access the contents, and a lid covering the opening and securing the contents. The term "lid" is intended to encompass caps, such as can be screwed or snapped on the neck of a bottle. Typically, the side walls of the lid engage the outer circumference of the opening in the receptacle. Commonly, lids for medicine containers are removed by twisting the lid relative to the receptacle. Medicine containers are often provided with "child proof" lids, as is known in the art, which may require the application of downward or upward force on the lid, pinching the lid to disengage a latching mechanism, or twisting the lid to align a latching mechanism in the open position before the lid may be lifted free. Lids that are removed by twisting, with or without the application of downward or upward force, are referred to generally herein as "twist-off" lids.

Figure 1:
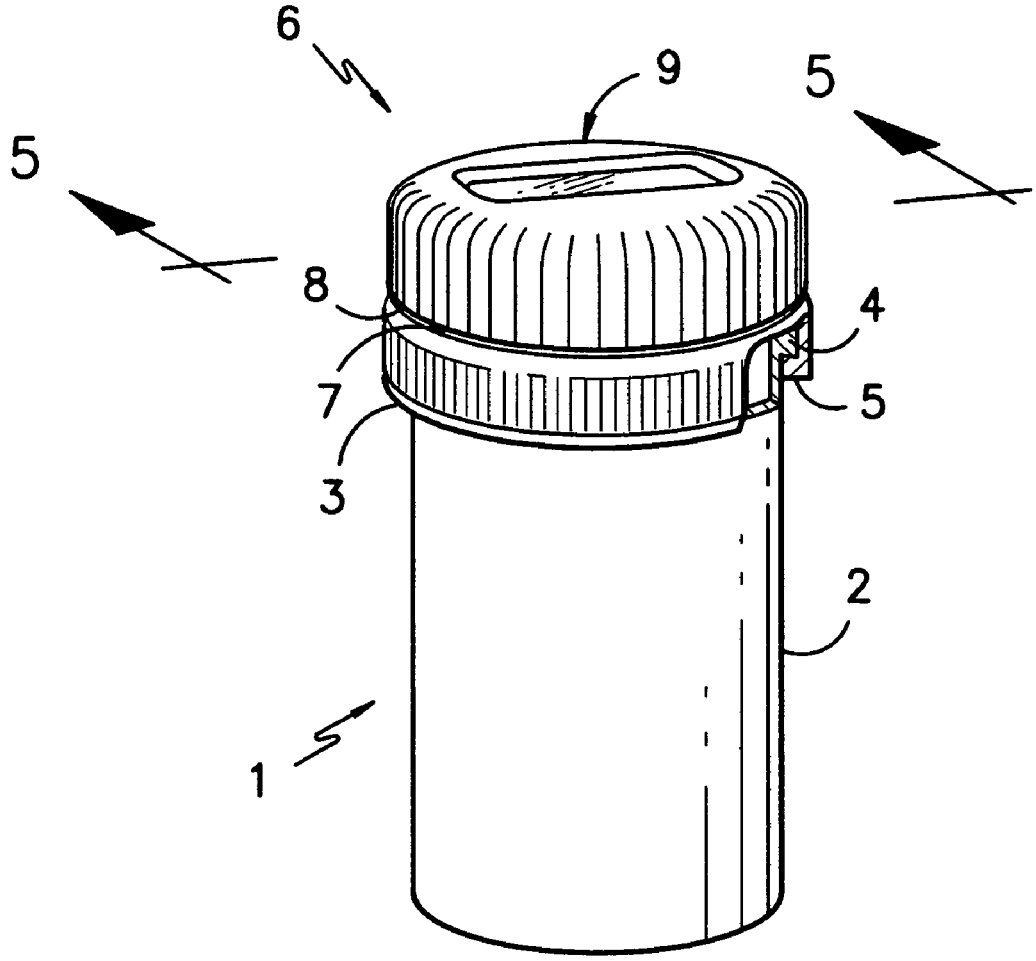
FIG. 1 is a perspective view of a typical medicine container with the add-on timer affixed to the lid.

Referring to FIG. 1, container 1 comprises receptacle 2 and lid 3. A portion of lid 3 is cutaway to show a closure mechanism commonly used for medicine dispensers. Receptacle 2 has a series of raised structures around its outer circumference forming notches 4. The inner circumference of lid 3 has a series of protruding pins 5, which engage notches 4, thereby holding lid 3 securely in place. Lid 3 is removed by exerting downward (compressive) force to disengage pins 5 from notches 4, and then twisting lid 3, relative to receptacle 2.

Add-on timer 6 is affixed to lid 3 of container 1. Base plate 7 has adhesive layer 8 on its underside, which bonds base plate 7 to the upper surface of lid 3. Housing 9 overlays base plate 7 and is coupled thereto.

For example, the underside of the base plate may be provided with a pressure-sensitive adhesive layer. One side of the adhesive layer may be bonded to the base plate and the other side is tacky, and may be covered with a releasable film, which can be easily removed before the tacky side of the adhesive layer is pressed against the lid. The adhesive layer may contain a substrate, such as a stratum of foam, positioned between the underside of the base plate and the tacky side of the adhesive layer, so that the adhesive layer readily conforms to the surface of the lid to create a better seal, and so that the add-on timer may flex slightly relative to the lid, thereby inhibiting unintended removal of the timer. Alternatively, the means to affix the base plate to the lid may be a liquid adhesive applied to the respective surfaces and allowed to cure, or two-sided adhesive tape.

Figure 2:
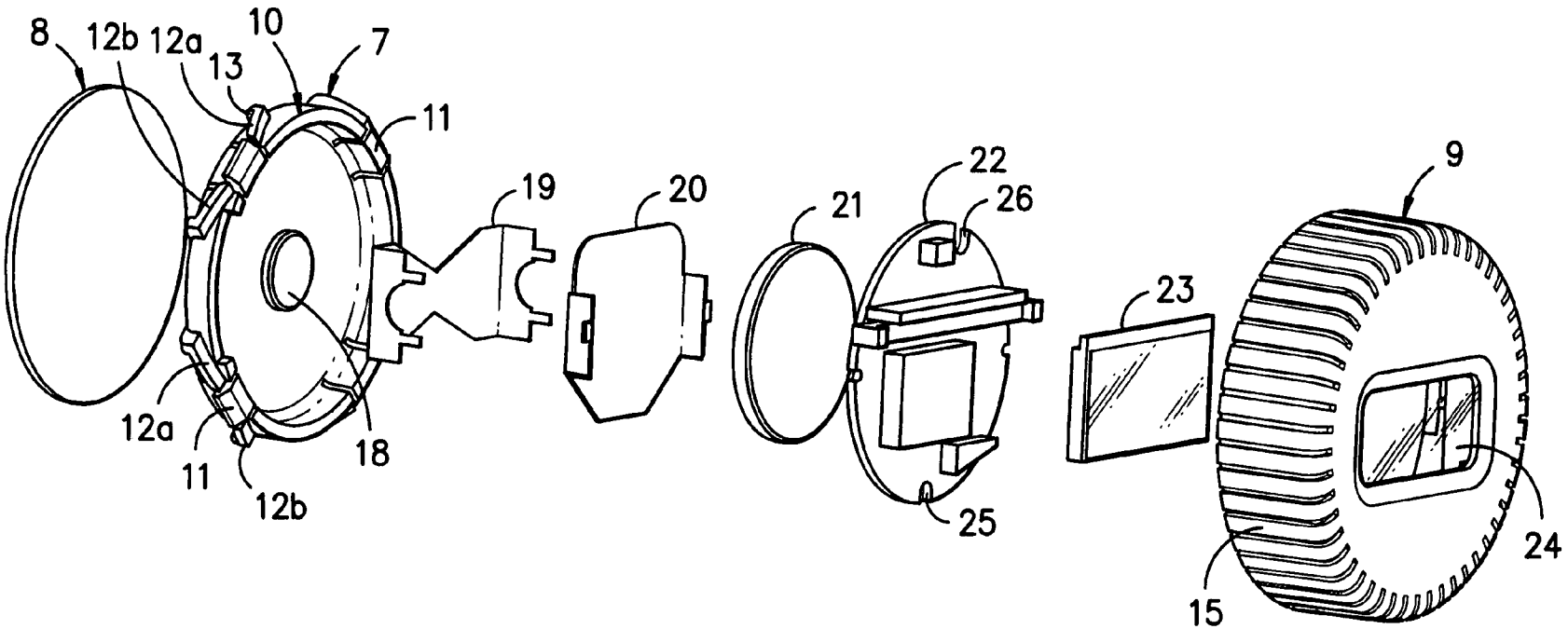
FIG. 2 is an exploded view of the add-on timer.

FIG. 2 is an exploded view of add-on timer 6. The underside of base plate 7 is coated with adhesive layer 8. Adhesive layer 8 may be conveniently covered with a releasable film (not shown), which can be removed prior to affixing the add-on timer to the lid of a container. A suitable adhesive is selected to adhere to the materials used in construction of the base plate and typical lids, as is known to those skilled in the art. Examples of a suitable adhesive are pressure sensitive adhesives (PSAs), in particular, high-performance permanent PSAs, rubber adhesives and acrylic adhesives. The adhesive may be applied to base plate 7 with a liquid carrier or in solid form. In an alternative embodiment, the adhesive layer may include a substrate having an adhesive layer bonding a first side of the substrate to the underside of base plate 7, and an adhesive layer bonding a second side of the substrate to a lid. The adhesive used on each side of the substrate may be the same or different.

In one embodiment of the invention, the housing and base plate snap together. By way of example, a snap lock assembly may be used to couple the housing and base plate together. A plurality of snap locks may be positioned around the perimeter of the base plate, and engaged with tabs extending from corresponding snap locks positioned around the inside of the side walls of the housing. In another example, an interlocking tab and track assembly may be used to couple the housing and base plate together. A plurality of tabs may be positioned around the inside of the side walls of the housing and engaged in corresponding tracks positioned around the perimeter of the base plate. The tabs slide within the tracks allowing relative movement between the housing and the base plate. The tracks may be in the shape of slots, that is, an opening cut through the component. The track may be horizontal, at an angle or perpendicular relative the plane of the base plate.

By way of example, a means to draw the housing toward the base plate when the housing is pivoted is to provide one component (housing or base plate) with a plurality of tracks and the other component having a plurality of tabs, whereby the components are mated to allow the tabs to slide in the tracks. The tracks are angled relative to a plane defined by the base plate, so that the housing is displaced downward when the housing is pivoted, that is, twisted. Stops may be provided at the end of the tracks to constrain the housing from pivoting further, once the housing is displaced from a first position away from the base plate to a second position, toward the base plate.

In one example, the side walls of the housing are configured to encircle the perimeter of the base plate. Further, the tracks and tabs may be located on the perimeter of the base plate and the inside of the side walls of the housing, respectively, or the relative location of the tracks and tabs may be reversed, that is, the tracks provided in the side walls of the housing and tabs protruding from the perimeter of the base plate.

In another embodiment of the invention, the means to draw the housing toward the base plate a sufficient distance to actuate the switch and reset the clock when the housing is pivoted, operates both when the housing is turned clockwise and counterclockwise, relative to the base plate. For example, tracks may be provided in the perimeter of the base plate that angle in two different directions, relative to the position of a tab, when the housing is in the first position away from the base plate, or neutral position.

The term "track" is intended to encompass a guide for directing the travel of a complimentary projection, whether the track is bordered on one side or two sides, and whether created by a groove in the surrounding material, an extension of the surrounding material, or a slot created in the material. The term "tab" is intended to encompass a structure projecting from the surrounding material that is capable of mating with and sliding in a track.

Figure 3:
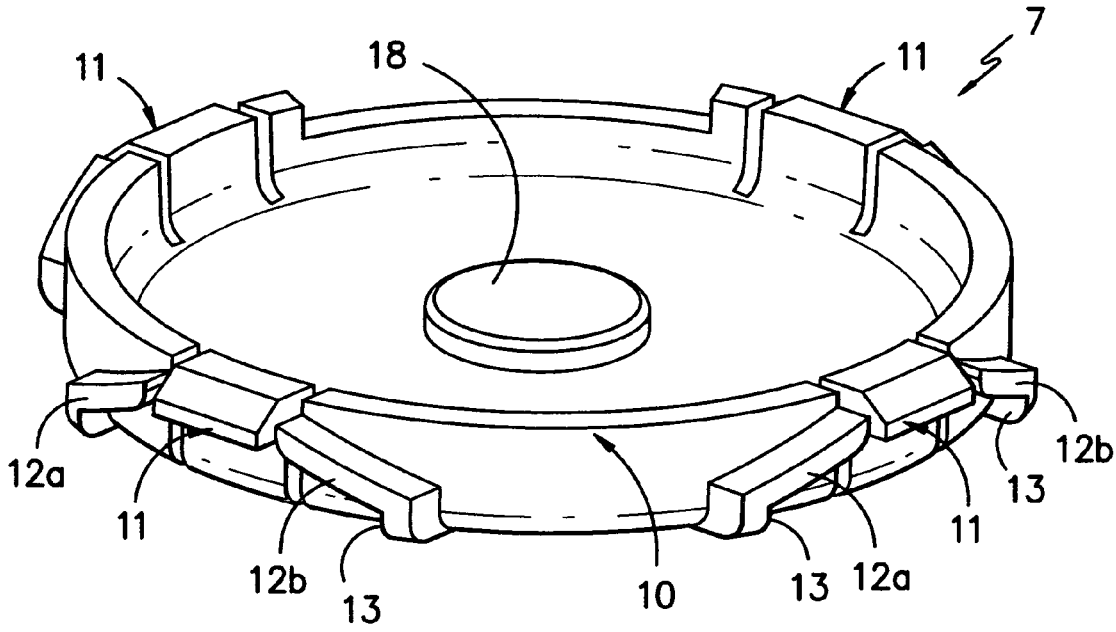
FIG. 3 is a perspective view of the upper side and perimeter of the base plate component of the add-on timer.

Base plate 7 is shown in detail in FIG. 3. The perimeter 10 of base plate 7 is provided with snap locks 11, which are designed to engage corresponding snap locks on housing 9, thereby coupling base plate 7 and housing 9 together. The perimeter 10 of base plate 7 is further provided with tracks 12*a* and 12*b* spaced on either side of snap locks 11. Tracks 12*a* and 12*b* are slanted downward relative to the plane defined by base plate 7. Stops 13 are provided at the lower end of tracks 12*a* and 12*b*.

In one embodiment of the invention, the battery, clock, display and means to detect a switch actuation event and reset the clock are affixed to the underside of the housing. The switch may be affixed to the underside of the housing, or separate components of the switch may be affixed to the housing and base plate and brought into electrical contact (or separated from contact) when the housing is displaced relative to the base plate.

As the means to detect a switch actuation event and reset the clock, the timing unit may contain an electrical circuit connected to the switch. When the status of the switch changes, for example, the switch has been opened or closed, the circuit detects the change and resets the clock. Alternatively, the electric circuit may measure the electrical resistance in the switch, compare the resistance to a set point to determine whether a threshold level as been met, and reset the clock when the threshold change in resistance has been met or exceeded.

In another embodiment of the invention, the switch may be designed to break the electrical circuit between the battery and the clock, upon displacement of the housing relative to the base plate. The clock can be designed to reset when the switch is actuated and power supply has been interrupted, such as in U.S. Pat. No. 5,751,661.

Figure 4:
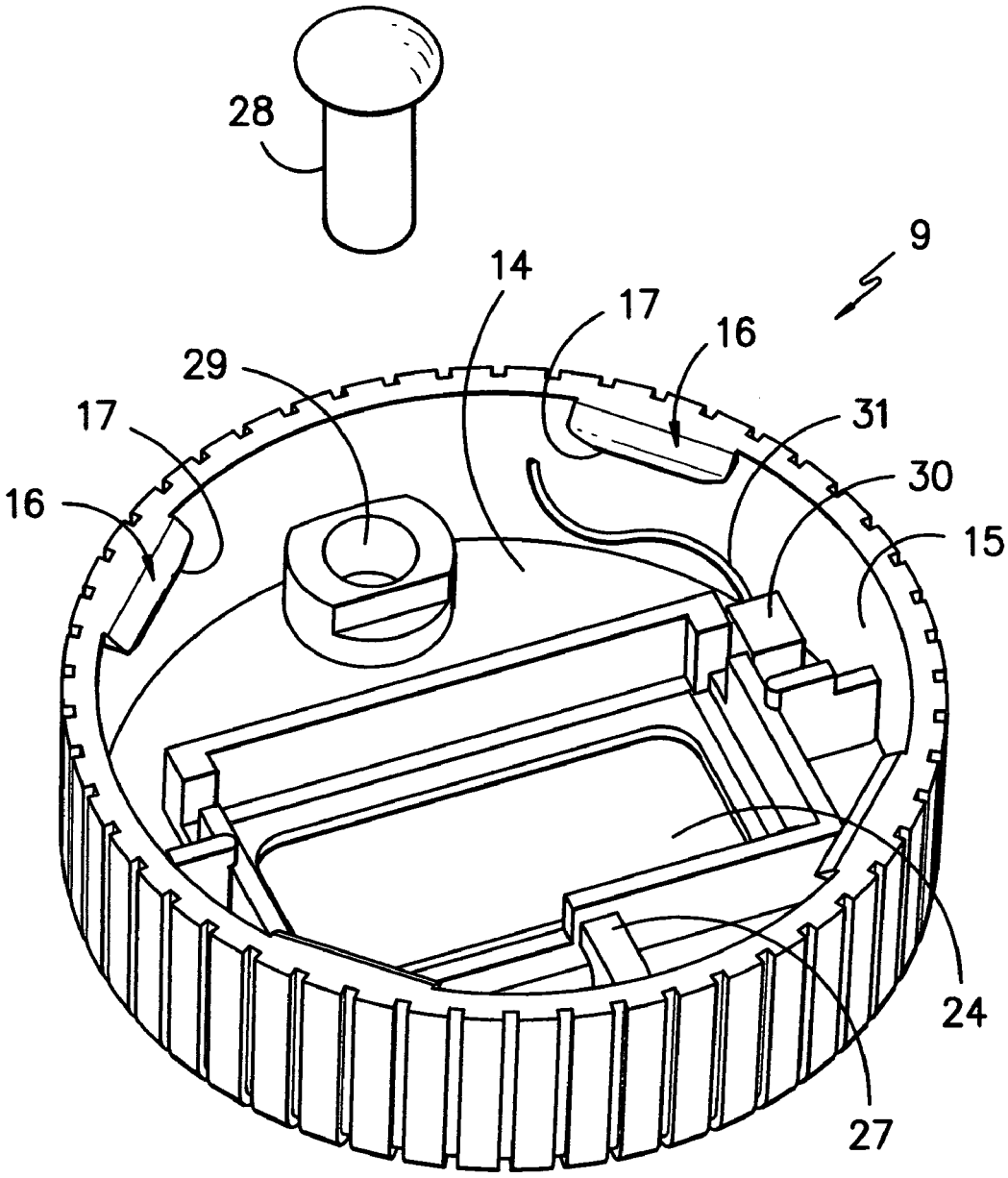
FIG. 4 is a perspective view of the underside and side walls of the housing component of the add-on timer.

FIG. 4 is an oblique view of the underside of housing 9, which is in the shape of a cap comprised of top 14 and side walls 15. Snap locks 16 are spaced around the inner circumference of side walls 15. Snap locks 16 serve two functions in the embodiment shown. First, snap locks 16 are configured to engage corresponding snap locks 11 on base plate 7, thereby coupling housing 9 to base plate 7, while allowing relative movement between the two in both a compressive (towards each other) and rotational direction. Second, when rotational force is applied to housing 9 causing it to pivot relative to base plate 7, tabs 17 of snap locks 16 engage tracks 12*a* or 12*b* of base plate 7. Because tracks 12*a* and 12*b* are angled downward, housing 9 will be drawn toward base plate 7. It can be understood that twisting housing 9 clockwise will engage tabs 17 with tracks 12*a*, and twisting housing 9 counterclockwise will engage tabs 17 with tracks 12*b*. Thus, twisting the housing relative to the base plate in either direction has the effect of forcing the tabs 17 downward along the tracks, thereby drawing the housing downward and actuating the timing unit switch. The side edges of tabs 17 and the upper ends of tracks 12*a* and 12*b* may each be beveled or rounded, to facilitate the tab engaging the track.

In one embodiment of the invention, the switch is pressure activated. For example, the switch may be an electrical circuit that is normally open or normally closed, and when the housing is displaced from the first position away from the base plate to the second position toward the base plate, the switch is closed or opened, respectively. In another example, the switch may be a pressure-sensitive resistive device, such as a strain gauge. Pressure applied to the switch causes a detectable change in resistance. A button or other raised area on the upper side of the base plate may be provided to press against and actuate the switch, when the housing is displaced toward the base plate. In yet another example, the switch is actuated by relative rotational movement between the housing and the base plate.

The add-on timer may be provided with a means to bias the housing back to a first position, away form the base plate, when one releases the housing, so that the switch returns to its pre-actuated or neutral position. For example, the timer may be provided with a spring plate, positioned between the base plate and the timing unit, to bias the housing away from the base plate, when compressive and/or rotational force on the housing is released.

Referring to FIG. 2, when housing 9 is displaced from a first position away from base plate 7 to a second position towards base plate 7, button 18 on the upper side of base plate 7 is urged against spring plate 19, which flexes and makes contact with battery case 20. Spring plate 19 is attached to the underside of housing 9. After housing 9 is released, that is, compressive or rotational force is no longer applied, spring plate 19 flexes outward, returning to a neutral position away from battery case 20, and housing 9 returns to a first position away from base plate 7.

Battery plate 20 holds battery 21 in contact with the underside of circuitry 22. Both spring plate 19 and battery plate 20 are electrically connected to circuitry 22, which includes the means to detect a switch actuation event and reset the clock and includes an internal clock. It can be understood that when spring plate 19 is urged against battery case 20, the circuit is closed and the switch is actuated. Thus, the switch comprises spring plate 19 and battery case 20, with spring plate 19 serving a second function of flexing outward to open the switch when housing 9 is released.

The clock may be a digital clock, and the display may be a digital readout, such as an LCD. The time elapsed from when the clock was last reset appears in the display, and may conveniently be shown in hours and minutes. The display may appear through a transparent cover mounted in the top of the housing, or it may appear through an opening in the top of the housing.

The elapsed time is shown in LCD display 23. LCD display 23 may be affixed to upper side of circuitry 22, and positioned to be viewed through window 24 in top 14 of housing 9. Referring to FIGS. 2 and 4, circuitry 22 is affixed to the underside of top 14. Notches 25 and 26 in the perimeter of circuitry 22 engage prong 27, extending from side wall 15 of housing 9 and rivet 28, inserted in hole 29 in the underside of top 14, respectively.

A universal serial bus (USB) port 30 is provided in the side wall 15 of housing 9, and USB port 30 is connected to circuitry 22 by electrical cable 31. Circuitry 22 may be provided with a memory functionality that allows the add-on timer to store a history of the time elapsed between doses, that is, between times the clock has been reset by a person accessing the container. The stored history could be downloaded to a computer, such as a PC, and reviewed by a health care provider or person supervising a patient.

Figure 5:
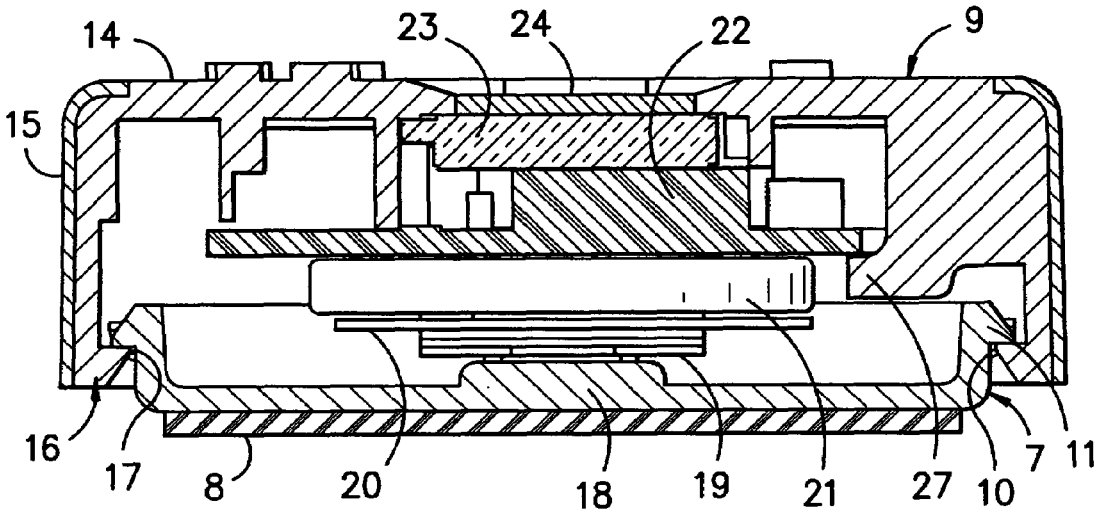
FIG. 5 is a cross-sectional view of the add-on timer taken along the lines of 5-5 shown in FIG. 1.

FIG. 5 is a cross-section of add-on timer 6, taken along the line 5-5 of FIG. 1. It can be understood that applying a compressive force in a direction perpendicular to base plate 7 will displace housing 9 downward. Sufficient clearance is allowed for the lower edge of side wall 15 to displace downward and actuate the switch, before the lower edge of side wall 15 contacts the lid to which add-on timer is affixed. Alternatively, the circumference of side walls 15 may be greater than the circumference of lid 3, thereby allowing downward displacement of housing 9 sufficient to actuate the switch.

In one embodiment of the invention, the side walls 15 of housing 9 are substantially perpendicular to top 14. By way of example, side walls having a height of 5 mm or greater allow sufficient room for positioning the timing unit between the housing and the base plate, and to provide a convenient place to grip the housing when removing the lid of a container to which the add-on timer has been affixed. In one embodiment, the height of the side walls is between 5 and 20 mm, preferably between 5 and 15 mm.

In another embodiment of the invention, a means to draw the housing toward the base plate when the housing is pivoted is to couple the housing and the base plate together by a plurality cords, each cord having one end attached to the housing and the other end attached to the base plate. The cord is sufficiently flexible or is allowed to pivot at the point of attachment, to allow relative movement between the housing and the base plate. The cords are angled upward or even perpendicular, relative to the plane of the base plate. Further, at least one of the ends of attachment of the cords is not positioned on the axis of rotation of the housing. For example, each of the cords may have one end attached at or near the perimeter of the base plate and the other end attached at or near the perimeter of the top of the housing, so the cord is substantially perpendicular, relative to the base plate. It may be understood that pivoting the housing will tension the cord and force the housing downward relative to the base plate.

The term "cord" is intended to encompass monofilaments, multifilament yarns and cables, ribbon, tapes, spokes, rods and bolts. In one example, the material used for the cords has high tensile strength and relatively low stretch (high modulus), such as polyamide, including nylon and aramid, polyester, and carbon fibers. In another example, the cord may be relatively stiff, such as a molded plastic spoke, rod or bolt. In the case of a cord in the shape of a spoke, rod or bolt, the cord would be slender, to allow flexing or bowing when compressive force is applied to the housing, thereby allowing displacement of the housing towards the base plate.

Figure 6:
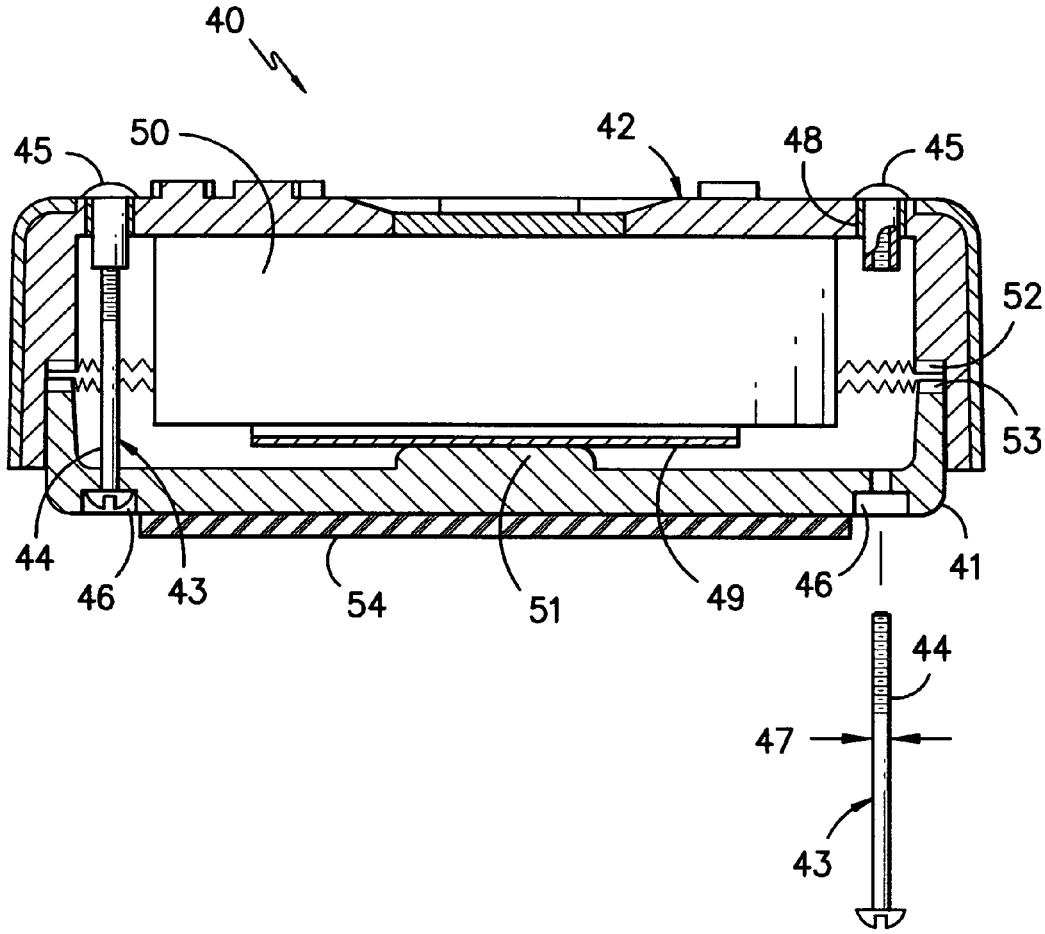
FIG. 6 is a cross-sectional view of the add-on timer in which the housing is coupled to the base plate with a plurality of cords.

FIG. 6 shows an embodiment of the invention in which the means to draw the housing toward the base plate when the housing is pivoted is to couple the housing and the base plate together by a plurality cords. Add-on timer 40 has base plate 41 coupled to housing 42 by a plurality of cords 43, which in the disclosed embodiment are plastic bolts 44 secured by nuts 45. Bolts 44 are countersunk in notches 46 provided in the underside of base plate 41. Bolts 44 are slender, shown as diameter 47, to allow flexing or bowing, when housing 42 is compressed perpendicular to base plate 41. Nuts 45 have flanges 48, which prevent restrict nuts 45 from rotating relative to housing 42, when cords 43 are assembled.

Housing 42 is free to pivot relative to base plate 41. When rotational force is applied to housing 42, cords 43 are simultaneously tensioned and caused to deflect from vertical, thereby drawing housing 42 downward toward base plate 41. Spring plate 49, attached to the underside of housing 42, is flexed upward to contact timing unit 50, when housing 42 is displaced downward. Spring plate 49 and timing unit 50 complete an electrical circuit, which resets the clock. Button 51 is a raised area on base plate 41, which presses against spring plate 49. Base plate 41 may be provided with reinforcing ribs (not shown), to prevent base plate 41 from flexing when cords 43 are tensioned.

Housing 42 may be displaced downward towards base plate 41 to actuate the switch to reset the clock by compressive force exerted perpendicular to housing 42. Teeth 52 and 53 may be provided on housing 42 and base plate 41, respectively, where the parts meet when housing 42 is displaced downward. Additionally, the teeth act in concert with the cords to limit relative rotation between housing 42 and base plate 41, when rotational force is applied and housing 42 is displaced downward a sufficient distance to actuate switch 49. After the teeth on housing 42 and base plate 41 are engaged, rotational force may be applied to remove a lid (not shown) to which add-on timer 40 has been attached via adhesive layer 54.

Add-on timer 40 is provided with a plurality of cords 43 spaced around the perimeter of housing 42 and base plate 41. By way of example, the add-on timer may be provided with at least 3 cords. In one embodiment, the add-on timer is provided with from 3 to 8 cords, preferably from 3 to 5 cords.

It can be understood that there are other methods of securing one end of each cord to the housing and the other end of each cord to the base plate. For example, each cord may be threaded between the housing and the base plate and the ends of the cord secured to the housing and base plate, respectively, by heat sealing or rivet. In another embodiment of the invention, each cord may be threaded between the housing and the base plate, with one end of the cord being provided with a head and the opposite end of the cord being secured by a locking mechanism, such as the mechanism used for cable ties or zip ties.

The base plate and housing may be formed of the same or different material. Examples of suitable materials include acrylonitrile butadiene styrene (ABS), polyurethane, polyvinyl chloride (PVC), and polyolefins, including polypropylene, polyethylene, in particular, high density and ultra high molecular weight polyethylene, and propylene/ethylene copolymers. The parts may be formed by injection molding or milling, or a combination of injection molding and milling.

The reliability of the add-on timer may be enhanced by employing the embodiment of the invention wherein the housing encircles the perimeter of the base plate, so that the housing rather than the base plate is offered to an individual to grasp. Nevertheless, it may be understood that the circumference of the base plate may be greater than the circumference of the housing, thereby allowing the side walls of the housing to slide within the perimeter of the base plate. In the latter embodiment of the invention, it is possible to mate the outside of the side wall of the housing and an inside flange extending upward from the base plate, with complimentary tabs and tracks, as heretofore described.

In one embodiment of the invention, the add-on timer is sized so that the circumference of the housing is approximately equal to (plus or minus 5%) or even greater than the circumference of the lid to which the add-on timer is affixed. Instead of reaching around or over the housing to grasp the lid, an individual is more likely to grasp the housing to remove the lid.

In one embodiment, the add-on timer housing is provided with rigid side walls, meaning the side walls are not compressed or distorted when downward force sufficient to open the lid is exerted on the top of the housing. For example, the rigid side walls slide perpendicular relative to the base plate, when the housing is depressed downward towards the base plate.

The timing unit may also feature a memory to store a history of reset events. For example, the time between reset events, corresponding to the time between accessing the medication, could be stored. In such an embodiment, a data access port or USB port could be advantageously located in the top or side wall of the housing. Stored data could then be accessed, transferred to an external computer, and analyzed.

The invention may be further understood by reference to the following claims.

I claim:

1. An add-on timer for attachment to a lid of a container, comprising:

(a) a base plate having an underside, a perimeter and an upper side, wherein the underside has means to affix the base plate to the lid;

(b) a housing having a top and side walls, wherein the housing is positioned to overlay the upper side of the base plate, and wherein the housing is coupled to the base plate to allow the housing to pivot relative to the base plate and to allow the housing to be displaced from a first position away from the base plate to a second position toward the base plate, while preventing the housing from becoming separated from the base plate;

(c) a switch, positioned between the housing and the base plate, which is actuated by displacement of the housing relative to the base plate;

(d) a timing unit, positioned between the housing and the base plate, the timing unit having a battery, a clock, a display, which is viewable from outside of the housing, and means to detect a switch actuation event and reset the clock; and (e) a means to draw the housing toward the base plate a sufficient distance to actuate the switch, when the housing is pivoted.

2. The add-on timer of claim 1, wherein the housing is drawn toward the base plate a sufficient distance to actuate the switch both when the housing is pivoted clockwise and counterclockwise.

3. The add-on timer of claim 1, wherein the timing unit is affixed to the underside of the housing.

4. The add-on timer of claim 1, wherein the side walls of the housing encircle the perimeter of the base plate, and the side walls of the housing are rigid.

5. The add-on timer of claim 1, wherein the housing can be displaced from a first position away from the base plate to a second position toward the base plate by compressive force perpendicular to the base plate.

6. The add-on timer of claim 1, wherein the means to draw the housing toward the base plate when the housing is pivoted comprises one of the perimeter of the base plate or the inside walls of the housing containing a track, and the other one containing a tab, wherein the track and the tab are mated to displace the housing toward the base plate a sufficient distance to actuate the switch, when the housing is pivoted.

7. The add-on timer of claim 1, wherein the side walls of the housing encircle the perimeter of the base plate, wherein (i) the base plate has a plurality of tracks spaced around the perimeter and angled downward relative to a plane defined by the base plate; and (ii) the housing has a plurality of tabs protruding from the inside of the side walls and engaging the tracks in the perimeter of the base plate, such that pivoting the housing displaces the housing toward the base plate.

8. The add-on timer of claim 1, wherein the means to affix the base plate to the lid is an adhesive layer provided on the underside of the base plate and positioned to adhere the base plate to an upper side of the lid.

9. The add-on timer of claim 1, wherein the means to draw the housing toward the base plate a sufficient distance to actuate the switch, when the housing is pivoted comprises a plurality of cords, each of the cords having one end attached to the housing and an opposite end attached to the base plate.

10. The add-on timer of claim 1, wherein the side walls of the housing encircle the perimeter of the base plate, and wherein the means to draw the housing toward the base plate a sufficient distance to actuate the switch when the housing is pivoted comprises at least three cords, each of the cords having one end attached to the top of the housing and an opposite end attached to the base plate, and the cords are substantially perpendicular to the base plate, when the housing is in a first position away from the base plate.

11. An add-on timer for attachment to a lid of a container, comprising:

(a) a base plate having an underside, a perimeter and an upper side, wherein the underside has means to affix the base plate to the lid;

(b) a housing having a top and rigid side walls, wherein the housing is positioned to overlay the upper side of the base plate with the side walls of the housing encircling the perimeter of the base plate, and wherein the housing is coupled to the base plate, to allow relative displacement between the housing and the base plate while preventing the housing from becoming separated from the base plate;

(c) a switch, positioned between the housing and the base plate, which is actuated by displacement of the housing relative to the base plate;

(d) a timing unit, affixed to an underside of the housing, whereby the timing unit moves with the housing relative to the base plate when the housing is displaced, the timing unit having a battery, a clock, a display, which is viewable from outside of the housing, and means to detect a switch actuation event and reset the clock;

(e) a means to return the housing to a neutral position, when a force causing displacement of the housing relative to the base plate is released; and (f) wherein the housing can be pivoted relative to the base plate, and the timer further comprising a means to draw the housing toward the base plate a sufficient distance to actuate the switch when the housing is pivoted.

12. The add-on timer of claim 11, wherein the housing is drawn toward the base plate a sufficient distance to actuate the switch both when the housing is pivoted clockwise and counterclockwise.

13. The add-on timer of claim 11, wherein the means to draw the housing toward the base plate when the housing is pivoted comprises one of the perimeter of the base plate or the inside walls of the housing containing a track, and the other one containing a tab, wherein the track and the tab are mated to displace the housing toward the base plate a sufficient distance to actuate the switch, when the housing is pivoted.

14. The add-on timer of claim 11, wherein the means to draw the housing toward the base plate a sufficient distance to actuate the switch when the housing is pivoted comprises at least three cords, each of the cords having one end attached to the top of the housing and an opposite end attached to the base plate, and the cords are substantially perpendicular to the base plate, when the housing is in a first position away from the base plate.

15. The add-on timer of claim 11, wherein the housing is displaceable from a first position away from the base plate to a second position towards the base plate, thereby actuating the switch, both by application of rotational force and compressive force.

16. The add-on timer of claim 11, wherein the means to affix the base plate to the lid is an adhesive layer provided on the underside of the base plate and positioned to adhere the base plate to an upper side of the lid.

17. A container, comprising:

(a) a receptacle;

(b) a lid having an upper side and an underside fitted to engage an opening in the receptacle;

(c) a base plate having an underside, a perimeter and an upper side, wherein the underside of the base plate is affixed to the upper side of the lid;

(d) a housing having a rigid top and rigid side walls, wherein the housing is positioned to overlay the upper side of the base plate with the side walls of the housing encircling the perimeter of the base plate, and wherein the housing is coupled to the base plate to allow the housing to pivot relative to the base plate and to allow the housing to be displaced from a first position away from the base plate to a second position toward the base plate, while preventing the housing from becoming separated from the base plate;

(e) a switch, positioned between the housing and the base plate, which is actuated by displacement of the housing relative to the base plate;

(f) a timing unit, affixed to an underside of the housing, the timing unit having a battery, a clock, a display, which is viewable from outside of the housing, and means to detect a switch actuation event and reset the clock; and (g) a means to draw the housing toward the base plate a sufficient distance to actuate the switch, when the housing is pivoted.

18. The add-on timer of claim 17, wherein the means to draw the housing toward the base plate when the housing is pivoted comprises (i) the base plate having a plurality of tracks spaced around the perimeter and angled downward relative to a plane defined by the base plate; and (ii) the housing having a plurality of tabs protruding from the inside of the side walls and engaging the tracks in the perimeter of the base plate, such that pivoting the housing actuates the switch, and wherein the base plate is affixed to the lid by an adhesive layer.

19. The add-on timer of claim 17, wherein the means to draw the housing toward the base plate when the housing is pivoted comprises a plurality of cords, each of the cords having one end attached to the top of the housing and an opposite end attached to the base plate, wherein the cords are tensioned when the housing is pivoted, thereby actuating the switch, and wherein the base plate is affixed to the lid by an adhesive layer.

20. The add-on timer of claim 17, wherein the housing can be displaced from a first position away from the base plate to a second position toward the base plate by compressive force perpendicular to the base plate.

* * * * *